US005175889A

United States Patent [19]

Infusino

[11] Patent Number: 5,175,889

[45] Date of Patent: Jan. 5, 1993

[54] INFLATABLE LINER FOR PROTECTIVE HEADGEAR

[75] Inventor: Ralph Infusino, Bloomingdale, Ill.

[73] Assignee: Riddell, Inc., Chicago, Ill.

[21] Appl. No.: 863,337

[22] Filed: Apr. 2, 1992

Related U.S. Application Data

[63] Continuation of Ser. No. 728,832, Jul. 9, 1991, abandoned, which is a continuation of Ser. No. 574,644, Aug. 29, 1990, abandoned.

[51] Int. Cl.[5] ..... A42B 3/00

[52] U.S. Cl. ..... 2/413; 2/425

[58] Field of Search ..... 2/411, 413, 417, 418, 2/419, 425, 410

[56] References Cited

U.S. PATENT DOCUMENTS

| | | | |
|---|---|---|---|
| 1,833,708 | 11/1931 | Ford . | |
| 2,150,290 | 3/1939 | Mulvey . | |
| 2,816,290 | 12/1957 | Boyer | 2/413 |
| 3,462,763 | 8/1969 | Schneider et al. . | |
| 3,600,714 | 8/1971 | Cade et al. | 2/413 |
| 3,668,704 | 6/1972 | Conroy et al. . | |
| 3,713,640 | 1/1973 | Margan | 2/413 |
| 3,761,959 | 10/1973 | Dunning | 2/413 |
| 3,866,243 | 2/1975 | Morgan | 2/413 |
| 3,994,020 | 11/1976 | Villari . | |
| 3,994,021 | 11/1976 | Villari et al. . | |
| 3,994,022 | 11/1976 | Villari et al. | 2/413 |
| 4,014,048 | 3/1977 | Rappleyea | 2/413 |
| 4,051,556 | 10/1977 | Davenport et al. . | |
| 4,060,855 | 12/1977 | Rappleyea . | |
| 4,062,068 | 12/1977 | Davenport et al. . | |
| 4,124,904 | 11/1978 | Matthes | 2/413 |
| 4,287,613 | 9/1981 | Schulz | 2/413 |
| 4,326,303 | 4/1982 | Rappleyea . | |
| 4,335,472 | 6/1982 | Rappeyea . | |
| 4,375,108 | 3/1983 | Gooding . | |

FOREIGN PATENT DOCUMENTS

| | | | |
|---|---|---|---|
| 919352 | 1/1973 | Canada | 2/413 |

OTHER PUBLICATIONS

The Air Football '89 Publication.

*Primary Examiner*—Andrew M. Falik
*Assistant Examiner*—Michael A. Neas
*Attorney, Agent, or Firm*—Hopgood, Calimafde, Kalil, Blaustein & Judlowe

[57] ABSTRACT

An inflatable liner for protective headgear comprising, in accordance with one aspect of the present invention, a reinforced hollow strip for the reception and storage of fluid, the strip having a selected size so as to line the protective headgear and partially encircle a user's head, a reinforced hollow flap extension connected to the midsection of the strip so as to allow the fluid to flow freely therebetween, a valve for controlling the passage of fluid to and from the inflatable liner, and pockets for maintaining uniform inflation of the strip and flap extension.

8 Claims, 2 Drawing Sheets

INFLATABLE LINER FOR PROTECTIVE HEADGEAR

This application is a continuation of application Ser. No. 728,832, filed Jul. 9, 1991, now abandoned.

This application is a continuation of application Ser. No. 574,644, filed Aug. 29, 1990, now abandoned.

BACKGROUND AND SUMMARY OF THE INVENTION

The invention relates to devices for varying the size of headgear and, more specifically, to an improved inflatable liner for sizing helmets and the like.

Proper sizing of protective headgear is essential for providing adequate support and protection to a user's head. Practicality dictates that a single helmet shell be adjustable to fit a wide range of head sizes so as to accommodate nearly any user's head.

Conventional inflatable liners have taken a number of forms. Inflatable bag type liners, for instance, have been used to size the helmet shell interior by filling a gap formed between a protective cushion or skull harness and the helmet shell. The inflatable bag is equipped with a valve positioned for cooperation with a corresponding hole in the helmet shell. Size adjustment is accomplished by inflating and deflating the liner.

Other inflatable liner systems utilize a pair of inflatable cushion units, one being a ringlike cushion for lining the top of the helmet interior and the other being an arc-like inflatable cushion for lining the front and side portions of the helmet. Each cushion has a separate valve requiring inflation of each unit individually.

Still other inflatable liners comprise one or more separate spoke-like inflatable crowns. An upper ringlike tube is connected to a lower but larger ringlike tube by an array of hollow spokes so that air may flow freely between the upper and lower tubes.

However, some of these liners do not provide effective sizing of the helmet. The inflatable bag type liner, for example, varies the volume of the helmet shell interior by simultaneously changing the interior diameters of the helmet on all sides, whereas changing the temporal circumference of the shell is all that is necessary for sizing the helmet. The inflatable bag also permits air to shift from the sides to the top of the helmet upon impact, causing the helmet to loosen thereby decreasing the protective capacity of the helmet.

In addition, the use of separate inflatable cushions has been found cumbersome and time consuming. In particular, such cushions not only require inflation but also require proper balancing of the pressure in each cushion to achieve uniform sizing of the helmet. These cushions have also been found costly to manufacture due to their complexity and the quantity of the materials necessary to achieve both protection and size variation.

Finally, should these conventional liners rupture from extensive use or impact, the entire helmet liner must be replaced at great expense to the user, since both protection and size variation are accomplished using a single complex liner system. Similarly, more durable liner materials have been found unsuitable for use with many such liner systems.

Thus, it is an object of the present invention to provide a simple, durable, efficient and economical inflatable liner for protective headgear which permits a single helmet shell to be adjusted to uniformly fit a wide rang of head sizes while providing crucial support and protection to the occipital protrusion and side portions of a user's head.

The above and other objects of the present invention are realized in a specific, illustrative embodiment of the inflatable liner which comprises a reinforced hollow expandable strip for the reception and storage of fluid, the strip having a selected size so as to line protective headgear and partially encircle a user's head, a reinforced hollow flap extension connected to the strip midsection for allowing the fluid to flow freely therebetween, a valve for controlling the passage of fluid to and from the inflatable liner, and pockets for maintaining uniform inflation of the strip and flap extension.

BRIEF DESCRIPTION OF THE DRAWINGS

The above and other features and advantages of the present invention are realized in a specific, illustrative embodiment thereof, presented hereinbelow in conjunction with the accompanying drawing, in which.

DETAILED DESCRIPTION OF A PREFERRED EMBODIMENT

Figure 1:
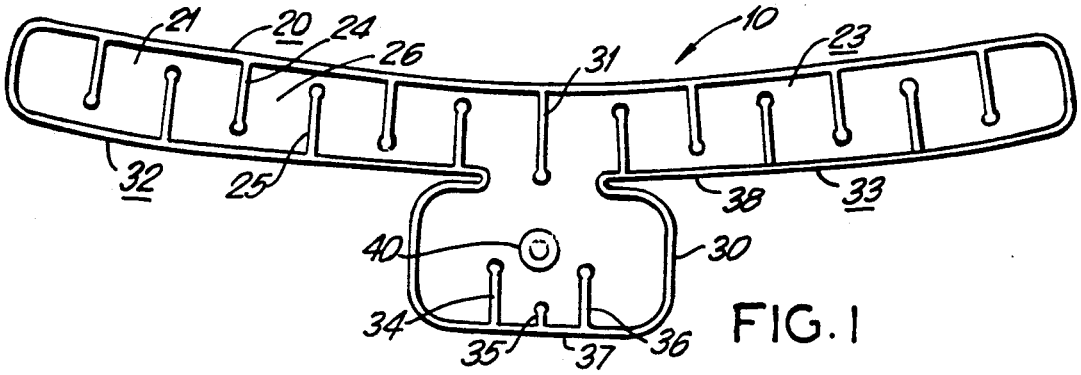
FIG. 1 is a plan view of an inflatable liner for protective headgear in accordance with the present invention.
Figure 2:
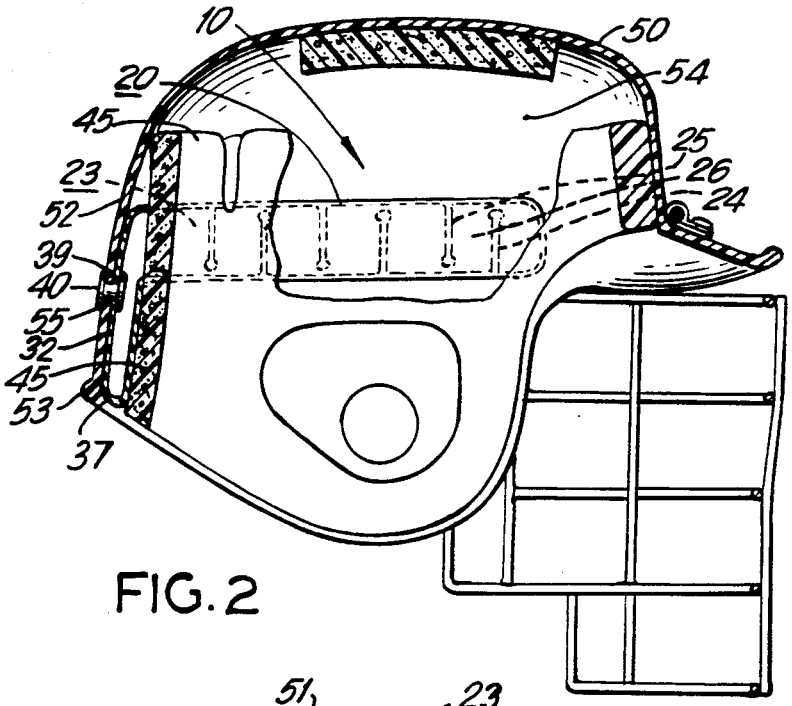
FIG. 2 is a side sectional view of a helmet shell showing the assembly of FIG. 1 in an operative position.

Referring now to the drawings and more particularly to FIG. 1, there is shown generally an inflatable member or liner 10 for varying the size of protective headgear or helmet 50, best seen in FIG. 2, to accommodate a wide range of head sizes. The liner comprises an inflatable strip 20, a flap extension 30 and a valve 40 formed in the flap extension.

Inflatable strip 20 is formed by a pair of long rectangular sheets 21, 22 (shown in FIG. 3) constructed, for example, of resilient plastic or the like and secured to one another along their respective peripheral edges so as to form a leakproof seal. Upon securing the sheets to one another, an inflatable cavity o chamber 23 is formed between the sheets. Although the sheets may be secured in any suitable fashion, it has been found that heat sealing provides a superior seal which is both durable and leakproof.

A series of parallel ribs 24, 25 are formed at intervals along the length of the strip extending inwardly from alternating sides thereof. This rib orientation provides a serpentine pathway for the flow of fluid through the strip. Each pair of ribs 24, 25 also define pockets 26 for the storage of fluid. This rib and pocket arrangement provides a number of advantages. First, the ribs serve to reinforce the inflated strip to withstand impact forces exerted o the helmet. In addition, the pockets formed by the ribs maintain uniform inflation of the strip at a selected size.

Hollow flap extension 30 is joined to the midsection of the strip lower edge 38 in a manner which allows fluid flow therebetween. Another rib 31, located at the strip midsection, partitions the strip into first and second portions 32 and 33, respectively. Upon the introduction of fluid into the liner, this rib diverts the fluid flow from one portion of the strip into the flap extension, and subsequently guides the fluid into the other portion of the strip. Thereby, rib 31 causes the fluid to circulate uniformly to all parts of the inflatable liner.

Flap extension 30 also has ribs 34, 35 and 36 extending inwardly from its lower edge 37. These ribs provide added strength to the inflated flap extension for withstanding impact forces applied to the helmet rear.

A centrally located hole 39 in flap extension 30 mounts a valve 40, for example, by heat sealing such that a leakproof seal is formed about the valve. Although the invention is depicted as using a valve, it is understood that any means for controlling the flow of fluid to and from the liner could be utilized giving consideration to the purpose for which it is intended.

The inflatable strip and flap extension arrangement is advantageous in providing, through the reinforced pockets, a uniformly inflated chamber which maintains a constant size while providing uniform support to the head during both a deformed state (upon impact to the helmet) and an undeformed state.

Figure 3:
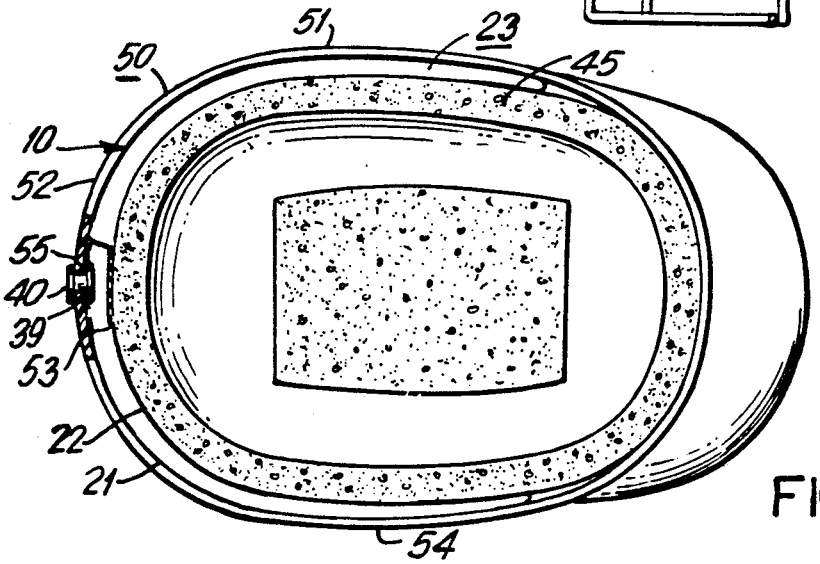
FIG. 3 is a bottom view of the assembly of FIG. 2 without the face guard.
Figure 4:
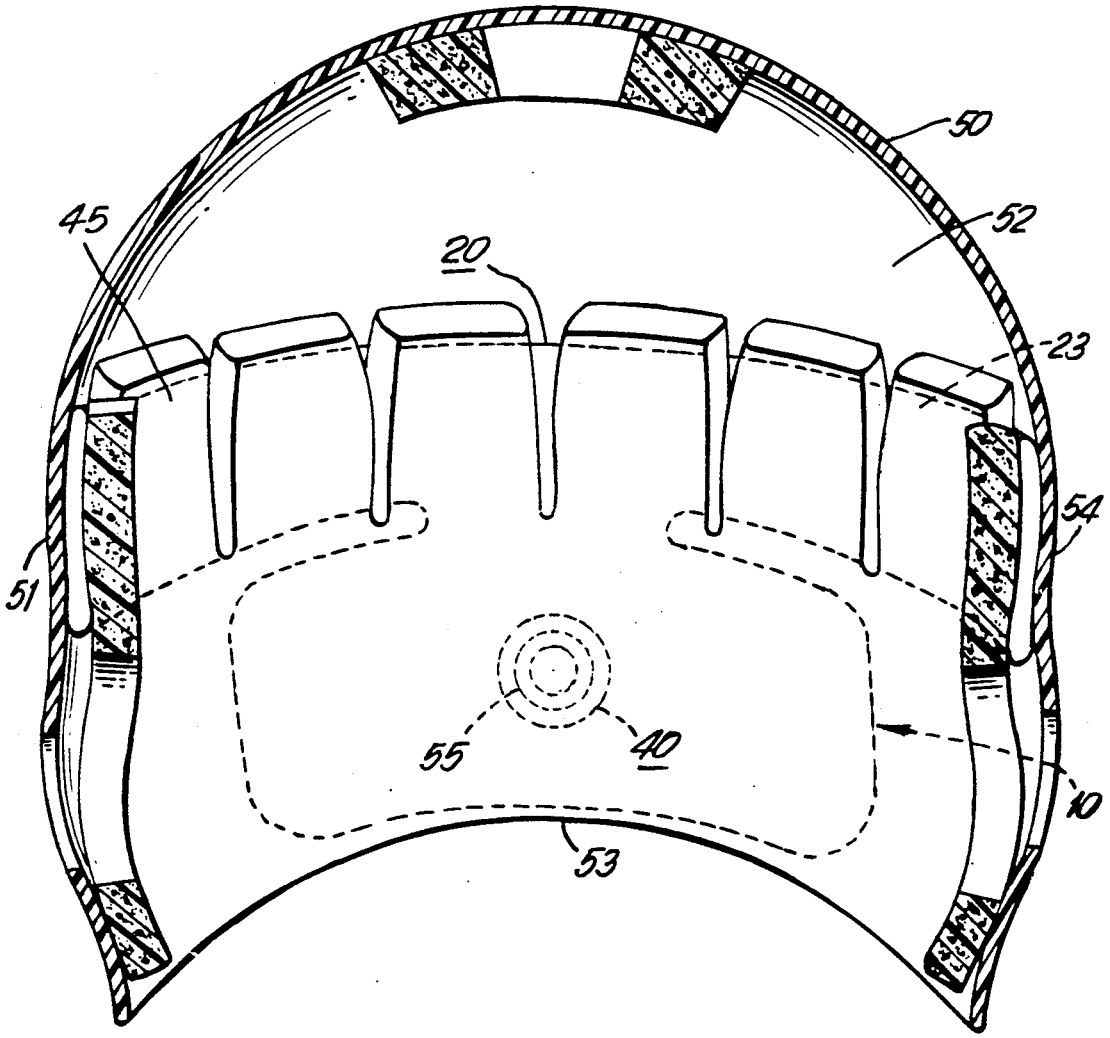
FIG. 4 is a sectional view taken along line 4—4 of FIG. 3.

To mount the inflatable liner inside helmet 50, inflatable strip 20 is first positioned between liner cushion 45 and the helmet shell, as shown in FIGS. 2–4, such that the strip wraps around the shell interior. In the mounted position, the strip first portion, for instance, extends around the helmet left side 51, beginning near the temporal portion and extending sideways to the helmet rear 52. The flap extension wraps around a portion of the helmet rear side interior and hangs downward to its lower edge 53. The strip second portion extends sideways around to the helmet right side 54, ending proximate to the right temporal portion of the helmet. In this orientation, the first and second portions and the flap extension rest against the left, right and rear interior sides, respectively, of the helmet shell. In place, the strip is suitably positioned such that valve 40 cooperates with a hole 55 at the rear of the helmet. In this manner, the valve is accessible to an exterior pressure source.

In operation, the helmet is first placed on the user's head. A needle, for example, from an airpump or other suitable pressure source, is then inserted into the valve through the hole at the helmet rear. Next, a fluid such as air is introduced into the valve, flows into the flap extension and is diverted by rib 31 into the first and second strip portions. As air is pumped continuously into the flap extension and along the serpentine pathway of the strip, the strip and flap extension are inflated to a selected size.

Inflation of strip 20 causes the helmet liner to expand inwardly toward the helmet center. In this manner, the internal circumference of the helmet liner is decreased, shrinking the size of the helmet. In turn, by deflating the strip, the internal circumference of the helmet liner is increased, expanding the helmet size.

For any given helmet shell size, the helmet liner may be adjusted so as to accommodate a wide range of head sizes. The inflatable strip allows for adjustment of the helmet size front to back and side to side at a minimum cost to the user, while uniformly maintaining a selected size and proper support of the occipital protrusion of the user's skull. In this manner, the helmet interior may be conformed to the size and shape of nearly any head.

The present invention provides a simple, durable, reliable and economical inflatable liner system which facilitates size variation of a helmet without sacrificing protection of the user's head. It has been found that an inflatable liner which completely encircles the head, as shown by the prior art, is unnecessary for providing adequate protection or size variation. By permitting a single helmet shell to be retrofitted to a wide range of head sizes, the present invention provides tremendous cost savings to the consumer. Consequently, an athletic institution, for example, may reuse a large stock of helmets each season without having to purchase extra helmets to custom fit unusual head sizes and shapes. Because few helmet shell sizes (children through adult) would be necessary, tooling costs for manufacturing custom helmets would also be greatly reduced.

Finally, the present invention maintains the snug fit necessary to provide optimal protection from impact to the user's head. It has been found that a liner comprising a layer of synthetic material, for example, polyurethane foam having a thickness of approximately 9/16", and having spaced, upwardly extending projections is effective for absorbing most blows to the head experienced in contact sports. For this material to be effective, it must rest snugly against the head. The present invention provides a given helmet shell with the snug fit necessary for protection of a wide range of head sizes at a minimal cost to the user, a significant advance over the prior art. Because this invention is suitable for use in nearly any sized helmet shell, even greater cost savings in manufacturing may be achieved.

The above-described arrangement and methodology is merely illustrative of the principles of the present invention. Numerous modifications and adaptations thereof will be readily apparent to those skilled in the art without departing from the spirit and scope of the present invention. For example, although the present invention has been shown and described for use with a lacrosse helmet, it is understood that this invention could be modified to accommodate any type of protective or nonprotective headgear.

What is claimed is:

1. An inflatable liner for varying the size of protective headgear, the liner comprising a hollow member for the reception and storage of fluid, the member having a configuration so as to line the protective headgear and partially encircle a user's head, and including a hollow strip extending uninterrupted from temple to temple about left, rear and right sides of the head, the strip having a hollow flap extension formed integrally with the strip for supporting an occipital protrusion of the user's head; means for controlling the passage of fluid to and from the member; and means for maintaining uniform inflation of the member, the maintaining means including inwardly extending relatively parallel ribs arranged at intervals along alternating sides of the strip length and about the flap extension, at least one strip rib extending into the flap extension, so as provide a serpentine pathway for flow of fluid through the strip and flap extension.

2. The inflatable liner set forth in claim 1 wherein the control means includes a valve for controlling the passage of fluid to and from the member.

3. The inflatable liner set forth in claim 1 wherein the fluid comprises air.

4. The inflatable liner set forth in claim 1 wherein the hollow member further comprises upper and lower sheets connected to one another so as to provide a leakproof inflatable chamber.

5. A protective headpiece which comprises:

a headpiece shell;

a protective liner positioned inside the shell so as to form a gap between the liner and the shell; and an inflatable member adapted to substantially occupy the gap, abutt the shell and partially encircle a user's head, the member having a hollow flap extension formed integrally with the strip for supporting an occipital protrusion of the user's head and having a valve for inflating and deflating the member such that, upon positioning the member in the gap, the fit of the shell to the user's head can be varied, and means for maintaining uniform inflation of the member, the maintaining means including inwardly extending relatively parallel ribs arranged at intervals along alternating sides of the strip length and about the flap extension, at least one strip rib extending into the flap extension, so as to provide a serpentine pathway for flow of fluid through the strip and flap extension.

6. The protective headpiece set forth in claim 5 wherein the member comprises a hollow strip configured so as to partially encircle the user's head.

7. An inflatable liner for varying the size of protective headgear, the liner comprising a hollow member for the reception and storage of fluid, the member having a configuration so as to line the protective headgear and partially encircle a user's head, means for controlling the passage of fluid to and from the member, the member including a hollow flap extension formed integrally with the member for supporting an occipital protrusion of the user's head, and means for maintaining uniform inflation of the member, the maintaining means including inwardly extending relatively parallel ribs arranged at intervals along alternating sides of the strip length and about the flap extension, at least one rib of the strip extending into the flap extension, so as to provide a serpentine pathway for flow of fluid through the strip and flap extension.

8. The inflatable liner set forth in claim 7 wherein the supporting means includes a flap extension configured for cooperation with the occipital protrusion of the user's head.

* * * * *